US005819435A

United States Patent [19]

Tuggle

[11] Patent Number: 5,819,435

[45] Date of Patent: Oct. 13, 1998

[54] TELESCOPIC DUCT CONNECTION WITH DIMPLES

[75] Inventor: Gregory W. Tuggle, Spring Lake, Mich.

[73] Assignee: Nemco, Inc., Grand Haven, Mich.

[21] Appl. No.: 841,497

[22] Filed: Apr. 23, 1997

Related U.S. Application Data

[60] Provisional application No. 60/015,744, Apr. 23, 1996.

[51] Int. Cl.[6] ..... F26B 19/00

[52] U.S. Cl. ..... 34/235; 138/155

[58] Field of Search ..... 34/235; 138/155; 454/47, 903

[56] References Cited

U.S. PATENT DOCUMENTS

| | | | |
|---|---|---|---|
| 165,893 | 7/1875 | Umland | 138/155 X |
| 409,631 | 8/1889 | Cooper . | |
| 1,278,894 | 9/1918 | Falk . | |
| 1,661,674 | 3/1928 | Osborn . | |
| 2,509,782 | 5/1950 | Person, Jr. . | |
| 2,650,114 | 8/1953 | Epstein . | |
| 2,959,196 | 11/1960 | Truesdell et al. . | |
| 3,926,222 | 12/1975 | Shroy et al. | 138/155 X |
| 4,383,354 | 5/1983 | Saurenman et al. | 29/522 |
| 5,121,948 | 6/1992 | Anderson et al. | 34/235 X |
| 5,199,190 | 4/1993 | Mayer et al. | 34/235 |
| 5,651,732 | 7/1997 | Dufour | 454/47 |

*Primary Examiner*—Christopher Kilner

*Attorney, Agent, or Firm*—Rader, Fishman, Grauer & McGarry

[57] ABSTRACT

A duct connection system for use in a dryer ventilation duct system includes a pair of duct members that are joined together in overlapping relationship, and a connection joint for holding the duct members together. The connection joint includes a plurality of dimples projecting from an end portion and arranged circumferentially around one of the duct members for frictionally contacting another end portion of the other duct member. The end portions may be the ends of straight-walled duct components, or may be sleeves forming part of universal elbow sections, corrugated ducts, etc. The dimples extend either inwardly or outwardly from the end portion of the one duct member depending on whether the one duct member is received in or extends over the other duct member to frictionally engage and hold the duct members together. Each dimple includes a first frusto-conical crush zone integrally formed with the one end portion, and a second conical crush zone radially spaced from the first crush zone. The first and second crush zones are arranged along a common central axis. A method of forming the dimples includes positioning a ductile sheet material between a punch and oversize annular die and then positioning the punch in the die against the sheet material to thereby plastically deform the sheet material without shearing.

18 Claims, 2 Drawing Sheets

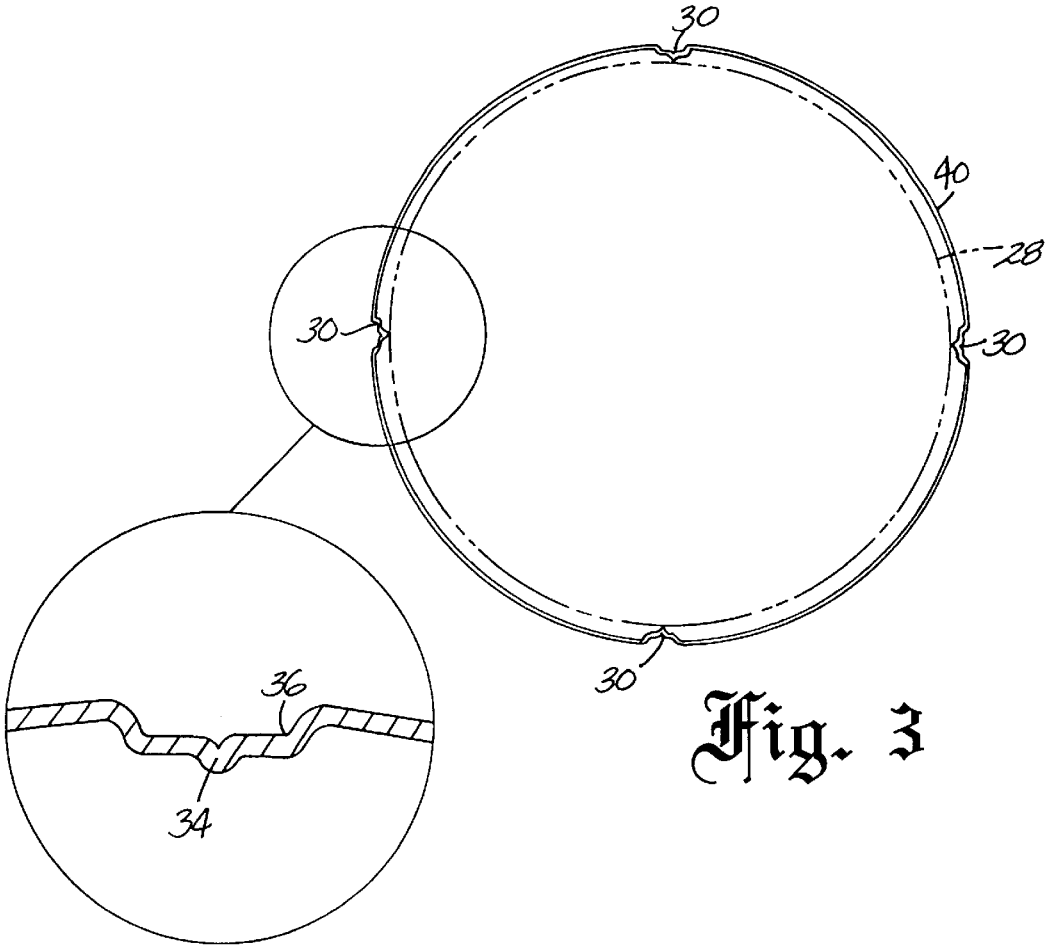
Fig. 3
Fig. 3A
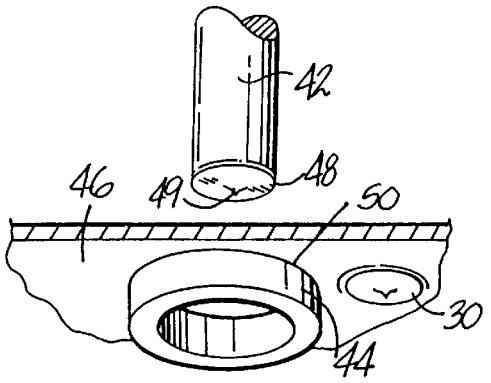
Fig. 4
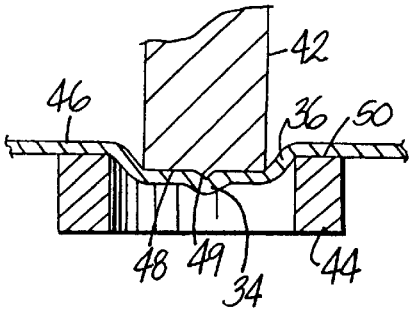
Fig. 5

TELESCOPIC DUCT CONNECTION WITH DIMPLES

RELATED APPLICATIONS

This application claims the benefit of U.S. Provisional Application No. 60/015,744 filed on Apr. 23, 1996.

BACKGROUND OF THE INVENTION

1. Field of the Invention

This invention relates to exhaust vent systems, and more particularly to exhaust vent systems for clothes dryers having a connection joint for attaching duct components together.

2. Description of the Prior Art

Dryer exhaust conduits conduct substantial quantities of heated air and lint from the dryer to an external location. Because of the amount of thermal energy involved in the vented air and in the dryer itself, dryer hose installation must be carefully made. Preferably, all-metal exhaust conduits are used throughout the dryer vent system. The conduits are usually solid wall construction or helical corrugation known as "flex" conduit, and have a large diameter opening on one end and a smaller diameter opening on another end, such that multiple conduits may be attached together through a telescopic fit. Two adjacent conduits are usually secured together in the telescopic arrangement by a band clamp, resulting in the kinking or crushing of one or both conduits. A kinked or crushed conduit could create a highly undesirable restriction causing reduced air flow resulting in lint build-up in locations of the kinked or crushed section. Moreover, the reduced air flow has been known to contribute to overheating the dryer motor, creating a significant fire hazard. The lint build-up constitutes combustible material in the event of a fire in the dryer. Dryers are most often fitted into a space just wide enough to receive them, i.e., confined between two walls, a washing machine and a wall, or a cabinet or shelving. Typically, it is practically impossible to make the connections between dryer vent components or to install clamps around the components after the dryer is against the wall. Consequently, homeowners and technicians that frequently install dryers find it difficult to make an effective dryer exhaust hook-up with metal components. Making the all metal connections when the dryer is still spaced several feet from the wall too often results in not being able to get the dryer close to the wall after the installation or, if the dryer is pushed close to the wall, the conduit sometimes undergoes additional crushing, kinking and/or flattening, resulting in poor air flow and possible fire hazard. Homeowners and dryer installation technicians sometimes use whatever materials are easy to manipulate, such as accordion-type vinyl or foil duct, that can be connected between the dryer exhaust duct and outside vent using typical band clamps. The results are far from ideal, since lint tends to build up in the crevices of the kinked portions of this type of duct. Moreover, vinyl and foil duct are not non-combustible. Hence, if a fire should occur in the dryer, it cannot be contained by the vent hose.

The problem has been further compounded in recent years due to a tendency to place dryers in small closets. Typically, such a closet will have a maximum of about 33 inches clearance. There is little or no room to connect the vent components together with their associated clamps, unless the dryer is outside of the closet at the time. Then, when it is pushed into the closet, it is easy for an all-metal conduit to get crushed, kinked, and/or flattened, resulting in poor air flow and undesired lint build-up.

SUMMARY OF THE INVENTION

An object of this invention is to provide a duct connection system wherein two conduits can be frictionally held together. Another object of this invention is to provide a dryer ventilation duct system that enables a workman to complete the duct hook-up simply by leaning over the dryer after it is adjacent the wall and sliding a pair of components together. The system enables the dryer to be positioned closely adjacent the wall, e.g., 3 or 4 inches therefrom, yet without the duct being kinked, crushed, and/or flattened.

According to one aspect of the invention, a duct assembly has first and second duct members. A first end portion of the first duct member extends past, i.e., extends over or under a second end portion of the second duct member when the duct members are connected together. A connection joint is provided for the first and second duct members that are in overlapping relationship when connected together. The connection joint includes one or more dimples projecting from an end portion of one of the duct members for frictionally contacting another end portion of the other duct member. The end portions may be the ends of straight-walled duct components, or may be sleeves forming part of universal elbow sections, corrugated ducts, etc. The dimple includes at least one crush zone that contacts the other end portion. The duct or dimple deforms when the end portions are connected together in overlapping relationship to thereby frictionally hold the duct members together.

According to a further aspect of the invention, the dimple extends either inwardly or outwardly from the end portion of the one duct member depending on whether the one duct member is received in or extends over the other duct member to frictionally engage and hold the duct members together.

According to an even further aspect of the invention, the dimple includes a first frusto-conical crush zone integrally formed with the one end portion, and a second conical crush zone radially spaced from the first crush zone. Preferably, the first and second crush zones are arranged along a common central axis.

A method of forming a dimple having at least one crush zone on a ductile sheet material according to the invention includes placing a sheet of ductile material between an annular die having an inner opening and a cylindrical punch that is in alignment with the annular die. The punch has an outer diameter that is substantially less than an inner diameter of the annular die. The phrase "substantially less than" as used herein refers to a punch diameter of any size that is smaller than the inner diameter of the die opening, such that the sheet material is deformed without shearing. The particular punch diameter depends on the sheet material thickness, the dimple height, and the inner diameter of the die. Once the sheet material is positioned between the punch and die, at least one of the punch and die is moved toward the other of the punch and die until the punch is positioned at least partially in the die inner opening against the sheet material to plastically deform the sheet material at least in the region between the punch and die and thereby form the dimple. The crush zone comprises the deformed region of sheet material. Dimples may be formed on the sheet material before the sheet material is formed into a duct, or may be formed on the sheet material after the duct is formed or on pre-existing ducts.

In a further aspect of the invention, the punch comprises a lower surface having a conical projection. The conical projection is pressed against the sheet material during the moving step to thereby form a second crush zone having a conical shape spaced from the first crush zone.

According to another aspect of the invention, a universal elbow connector normally having a female rotatable fitting on one end and a male rotatable fitting on the other end, includes a plurality of circumferentially-spaced dimples on one of the ends for receiving a duct component around the outside or inside of the end depending on which direction the dimples face, and the other end may be straight or crimped for insertion into another duct member. With the above arrangement, the use of band clamps is no longer necessary. Thus, the requirement to install the clamps in tight places is avoided. Without band clamps, the kinking or crushing of duct components associated with tightening the clamps is also avoided, leading to an easier and safer exhaust installation. The dimples may be associated with straight or curved vent components having male and female ends for connecting two duct members together with or without crimped ends.

These and other objects, advantages and features of the invention will become apparent from the following detailed description in conjunction with the drawings.

BRIEF DESCRIPTION OF THE DRAWINGS

The invention will now be described with reference to the drawings wherein:

FIG. 3 is a cross-sectional view of the assembled components according to the invention taken along line 3—3 of FIG. 2;

FIG. 3A is an enlarged view of one of the dimples shown in FIG. 3;

FIG. 4 is a perspective view of a punch and die for forming dimples; and

FIG. 5 is a cross-sectional view showing the formation of a dimple using the punch and die.

DESCRIPTION OF THE PREFERRED EMBODIMENTS

Figure 1:
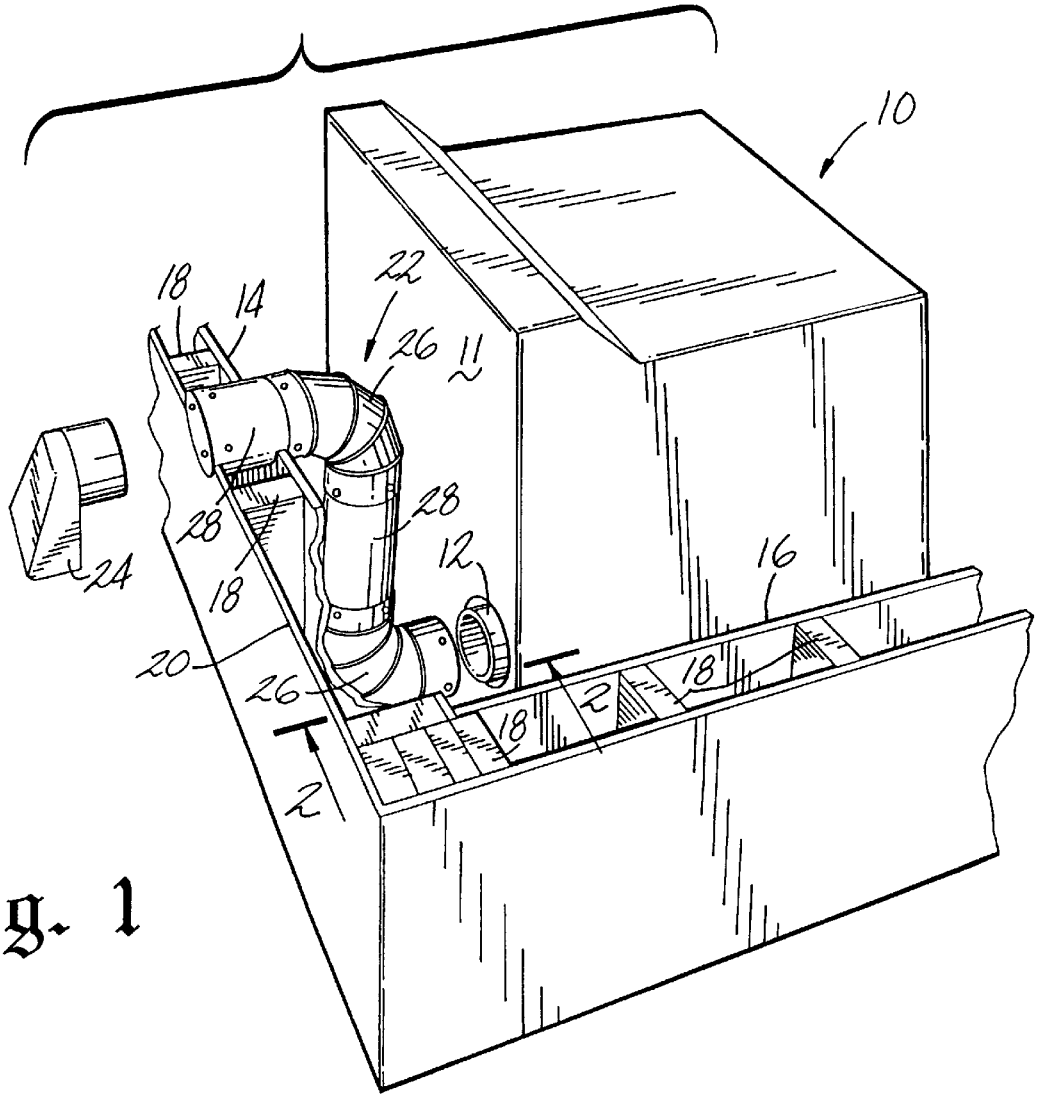
FIG. 1 is a perspective view of a dryer duct assembly of the present invention shown for attachment between an outside vent and the rear of a dryer.

Referring to FIG. 1, a dryer 10 has a dryer exhaust duct 12 extending rearwardly from dryer rear wall 11. In a common installation, dryer 10 is positioned adjacent to a first wall 14 and a second wall 16 or other structure. A plurality of studs 18 are usually located behind the walls and may include another wall 20 opposite to one of the walls 14, 16 for defining another room or the outside of a building structure. FIG. 1 shows an exemplary embodiment of a duct system 22 which connects an outside vent 24 to the dryer exhaust duct 12. Duct system 22 may include universal elbow sections 26 and straight sections 28.

Figure 2:
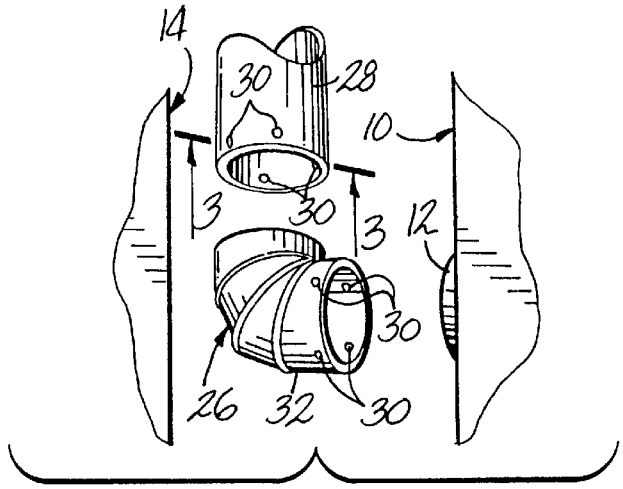
FIG. 2 is an enlarged perspective view of the dryer and duct interconnection assembly taken along line 2—2 of FIG. 1.

Turning now to FIGS. 2 and 3, universal elbow section 26 is commonly used with exhaust duct 12 such that the dryer 10 may be placed close to wall 14. A plurality of dimples 30 are located circumferentially around end section 32 of elbow 26 such that the dimples protrude inwardly. Alternatively, dimples 30 may be located or formed circumferentially around exhaust duct 12 such that they project outwardly of end section 32. Dimples 30 are preferably circular in nature, however, other shapes are also contemplated. In the preferred embodiment illustrated in FIG. 3A, dimples 30 include a first conical crush zone 34 and a second frusto-conical crush zone 36. The crush zones are preferably aligned along a common central axis. It is also anticipated that a single crush zone comprising a cone or other deformation in the sheet material of the conduit will suffice for a given dimple. When end 32 of elbow 26 is positioned around exhaust duct 12, first crush zone 34 will be in contact with the outer periphery of exhaust duct 12 such that the first crush zone 34 and second crush zone 36 are deformed. It is believed that much of the deformation is inelastic, i.e., resulting from deflection of the area between and surrounding the crush zones thereby imparting bias force to maintain the dimples in contact with the facing surface. It is also thought that where the first crush zone comprises a point, it will actually score the exhaust duct, creating further frictional engagement. It will be understood that the material typically used in dryer venting is sheet aluminum having a thickness of 0.010 to 0.015 inches. Thus it is not unusual for the surface against which the dimples bear to also be deflected, particularly when two vent conduits are joined.

As the zones or respective surfaces are deformed, elbow 26 is frictionally secured to exhaust 12 through press-fit engagement. Further clamping is not required. Likewise, straight section 28 can include a plurality of dimples 30 for fitting over end section 38 of universal elbow 26 in the same manner as previously described. This interconnection system is preferably used throughout the whole installation procedure for connecting the various components of the duct system 22 such that the dryer exhaust duct 12 is securely connected to the outside vent 24. Although it is preferred that duct 12 and section 38 are straight pipe sections, the dimples 30 also work with corrugated sections. The dimples 30 may be of various size and shape to accommodate a wide range of duct sizes and duct shapes. Moreover, although dimples 30 are shown as protruding inwardly into the opening of a duct section, the dimples may protrude outwardly on a mating duct section to accomplish the same results. The particular height of dimples 30 as measured from duct wall 40 to crush zone 34 can be varied to achieve different frictionally holding results. In some instances, one of crush zones 34 or 36 may be eliminated.

Although four dimples are shown spaced equally about the periphery of the duct, more or less dimples may be used. A second set of dimples may also be spaced apart and located about the periphery of a duct such that the additional dimples are aligned with the first set of dimples or are staggered with respect thereto. The two axially spaced sets of dimples 30 would permit inter-engaging duct portions to be aligned axially as well as held securely with respect to each other.

Referring now to FIGS. 4 and 5, there is shown a tooling method for forming the dimples 30. A punch 42 having a lower surface 48 and a conical protrusion 49 extending outwardly of the lower surface is axially centered over an oversized die 44. Punch 42 and die 44 are well known tools used together for forming holes in sheet material, such as sheet metal. However, punch 42 is usually associated with a die such that the outside diameter of punch 42 matches closely to the inside diameter of the die 44 for shearing the sheet material. However, according to the present invention, an oversized die 44 is used in conjunction with punch 42 to form the dimples 30. Alternatively, an undersized punch can be used in conjunction with the die. Since the die 44 is oversized (or the punch 42 is undersized), a hole will not be created in sheet material 46 since a shearing action between the punch and die are not created. In use, a sheet material 46 is supported by the oversized die 44 while a punch 42 is directed toward the opposing surface of sheet material 46. When the conical protrusion 49 and lower face 48 of punch 42 contact an upper surface of the sheet material 46, the sheet material is plastically deformed inside the die 44 creating the crush zones 34 and 36. Once the punch 42 is removed, the dimple now formed will maintain its shape. The dimples may be formed on the sheet material before the sheet material is formed into a duct, or may be formed on the sheet material after the duct is formed. In addition, the dimples may be formed on pre-existing ducts.

Manufacture of the apparatus is straightforward and can be automated. The unit can be readily installed by one of little skill and, in fact, no skill in the metal working field, to produce a safe arrangement. Conceivably, various details of this invention, as illustrated in the preferred embodiment, may be modified to suit a particular type of installation. Hence, the invention is not intended to be limited to the specific embodiments set forth as illustrated.

The embodiments of the invention in which an exclusive property or privilege is claimed are defined as follows:

1. A connection joint for a duct assembly having first and second duct members, a first end portion of the first duct member extending past a second end portion of the second duct member when the duct members are connected together, the connection joint comprising:

at least one dimple projecting from one of the end portions for frictionally contacting the other end portion, the dimple including at least one crush zone that contacts the other end portion, wherein one of the at least one dimple and other end portion deforms when the end portions are connected together in overlapping relationship to thereby frictionally hold the duct members together.

2. A connection joint according to claim 1 wherein the first end portion comprises a first wall fabricated from sheet metal and the dimple is formed unitary with the wall.

3. A connection joint according to claim 2 wherein the second end portion comprises a second wall fabricated from sheet metal, the first and second end portions being substantially similar in shape, the first end portion having a nominally larger perimeter than the second end portion to thereby telescopically receive the second end portion in the first end portion when the duct members are connected together; and further wherein the dimple extends inwardly from the first wall to frictionally engage and hold the second wall with respect to the first wall.

4. A connection joint according to claim 3 and further comprising a plurality of dimples spaced around the perimeter of the first wall and projecting inwardly therefrom to frictionally engage and hold the second wall with respect to the first wall.

5. A connection joint according to claim 4 wherein each dimple comprises a second crush zone spaced from the at least one crush zone.

6. A connection joint according to claim 2 wherein the second end portion comprises a second wall fabricated from sheet metal, the first and second end portions being substantially similar in shape, the second end portion having a nominally larger perimeter than the first end portion to thereby telescopically receive the first end portion in the second end portion when the duct members are connected together; and further wherein the dimple extends outwardly from the first wall to frictionally engage and hold the second wall with respect to the first wall.

7. A connection joint according to claim 6 and further comprising a plurality of dimples spaced around the perimeter of the first wall and projecting inwardly therefrom to frictionally engage and hold the second wall with respect to the first wall.

8. A connection joint according to claim 7 wherein each dimple comprises a second crush zone spaced from the at least one crush zone.

9. A connection joint according to claim 1 wherein the at least one dimple comprises a second crush zone spaced from the at least one crush zone.

10. A connection joint according to claim 1 wherein the at least one crush zone comprises a first frusto-conical crush zone integrally formed with the one end portion, and a second conical crush zone radially spaced from the first crush zone.

11. A connection joint according to claim 10 wherein the first and second crush zones are arranged along a common central axis.

12. A method of forming a dimple having at least one crush zone on a ductile sheet material, comprising:

providing an annular die having an inner opening;

positioning a cylindrical punch in mutual alignment with the annular die, the punch having an outer diameter that is substantially less than an inner diameter of the annular die;

positioning the sheet material between the annular die and cylindrical punch; and moving at least one of the punch and die until the punch is positioned at least partially in the die inner opening against the sheet material to plastically deform the sheet material at least in the region between the punch and die without shearing the sheet material and thereby form the dimple, the at least one crush zone comprising the deformed region of sheet material.

13. A method of forming a dimple according to claim 12 wherein the punch comprises a lower surface having a conical projection, and further comprising pressing the conical projection against the sheet material during the moving step to thereby form a second crush zone having a conical shape spaced from the first crush zone.

14. A method of forming a dimple according to claim 12 wherein the ductile sheet is a metallic sheet material.

15. A connection joint for a duct assembly having first and second duct members, a first end portion of the first duct member extending past a second end portion of the second duct member when the duct members are connected together, the connection joint comprising;

a plurality of dimples projecting from one of the end portions for frictionally contacting the other end portion, at least one of the dimples including at least one crush zone that contacts the other end portion, wherein one of at least one of the dimples and the other end portion deforms when the end portions are connected together in overlapping relationship to thereby frictionally hold the duct members together;

the first and second end portions being substantially similar in shape, the second end portion having a nominally larger perimeter than the first end portion to thereby telescopically receive the first end portion in the second end portion when the duct members are connected together; and further wherein the plurality of dimples extend outwardly from the first wall to frictionally engage and hold the second wall with respect to the first wall; and at least one of the plurality of dimples comprises a second crush zone spaced from the at least one crush zone.

16. A connection joint for a duct assembly having first and second duct members, a first end portion of the first duct member extending past a second end portion of the second duct member when the duct members are connected together, the connection joint comprising:

at least one dimple projecting from one of the end portions for frictionally contacting the other end portion, the dimple including at least one crush zone that contacts the other end portion, wherein one of the at least one dimple and other end portion deforms when the end portions are connected together in overlapping relationship to thereby frictionally hold the duct members together; and the at least one dimple comprising a second crush zone spaced from the at least one crush zone.

17. A connection joint for a duct assembly having first and second duct members, a first end portion of the first duct member extending past a second end portion of the second duct member when the duct members are connected together, the connection joint comprising:

at least one dimple projecting from one of the end portions for frictionally contacting the other end portion, the dimple including at least one crush zone that contacts the other end portion, wherein one of the at least one dimple and other end portion deforms when the end portions are connected together in overlapping relationship to thereby frictionally hold the duct members together; and the at least one crush zone comprising a first crush zone integrally formed with the one end portion, and a second crush zone radially spaced from the first crush zone.

18. A connection joint according to claim 17 wherein the first and second crush zones are arranged along a common central axis.

* * * * *